US005428929A

United States Patent [19]

Reese

[11] Patent Number: 5,428,929

[45] Date of Patent: Jul. 4, 1995

[54] COILABLE FLAT, BENDABLE STRIP FOR PROTECTING FINISHED CORNERS

[76] Inventor: Jeffery Reese, 714 W. Hackberry Dr., Arlington Heights, Ill. 60004

[21] Appl. No.: 919,367

[22] Filed: Jul. 23, 1992

[51] Int. Cl.[6] ..... E04B 2/00; E04F 13/06

[52] U.S. Cl. ..... 52/288.1; 52/287.1; 52/273; 52/255

[58] Field of Search ..... 52/288, 288 MF, 287 R, 52/273, 255, 288.1, 287.1

[56] References Cited

U.S. PATENT DOCUMENTS

| | | | |
|---|---|---|---|
| 3,200,547 | 8/1965 | Johnson . | |
| 3,444,657 | 5/1969 | Swanson | 52/288 |
| 3,475,871 | 11/1969 | Saunders et al. | 52/287 R |
| 4,313,991 | 2/1982 | Lamb | 52/255 |
| 4,544,593 | 10/1985 | Borgert | 428/80 |
| 4,704,837 | 11/1987 | Menchetti et al. | 52/273 |
| 4,977,718 | 12/1990 | Hoffman | 52/288 |

OTHER PUBLICATIONS

Hawley's Condensed Chemical Dictionary, 11th edition, Sax and Lewis, Sr. p. 933.

*Primary Examiner*—Carl D. Friedman
*Assistant Examiner*—Winnie Yip
*Attorney, Agent, or Firm*—Charles F. Meroni, Jr.

[57] ABSTRACT

A foldable translucent corner protector comprised of a flat strip of synthetic plastic, the corner protector having a V-shaped groove extending its length, the groove having a depth of 1/64" or less the V-shaped groove dividing the strip and enabling the strip to be bent from a flat form along its length to provide a pair of bendable strip leaves for attachment to an angled wall surface of varying sized angles about a wall corner for protecting the wall corner.

3 Claims, 2 Drawing Sheets

COILABLE FLAT, BENDABLE STRIP FOR PROTECTING FINISHED CORNERS

BACKGROUND OF THE INVENTION

1. Field of Invention

The present invention relates to a device used for protecting corners on walls from peeling wallpaper, chipping paint, and other damages sustained by people or other objects bumping or rubbing against corners of walls.

2. Prior Art

Many homes have corners that are adjacent to other rooms and since these corners are in general traffic patterns they are often brushed against or bumped, damage to wallpaper or paint will inevitably result. A current product on the market is a clear corner protector molded at a 90° angle at 8 foot lengths, but these are difficult to transport, not easily trimmed to fit and cannot protect corners that many new homes have. A lot of new construction contains corners of 45° in which case a 90° protector simply will not fit. According to my invention, I have discovered that a clear plastic strip with a "V" groove running along the center of the length of the strip can be easily transported, trimmed and folded. With my strip being divided along its length by a grooved area of reduced cross-sectional configuration a pair of flexible leaves are provided thus enabling my strip to be able to protect any angle corner from damage when applied to the corner.

SUMMARY OF THE INVENTION

The principal object of this invention is to provide transparent corner protection while maintaining convenient transportability, i.e. from a store to a home.

Another object of this invention is to provide corner protection on household or office corners that are other than 90°. Many newly constructed homes have angles of 45° in order to make more efficient use of space, and presently no device exists for protecting these corners embodying the advantageous features of my flat coilable, bendable protective strip for protecting finished corners.

A further object of this invention is to provide an improved coilable strip-type corner protector that when uncoiled can be more easily cut and trimmed to fit a corner shape. Currently a rigid 90° corner protector molded from plastic is being marketed that makes it somewhat difficult to trim to length to avoid certain obstacles like chair rails, etc.

The foregoing objects can be accomplished by providing a corner protector having a length of 8' that can be coiled and suitably secured in a circular coil form having a relatively small diameter such as 8"–10" or less depending on the thickness of the strip. This can be accomplished by coiling a strip of clear plastic with a "V" groove in the center providing flexible leaves that can flex about the groove for custom fitting to a variety of differently angled corners so that when it is ready to be installed it can be folded and then become rigid when attached to cover a corner to the walls defining the corner.

According to features of my invention, the strip has a "V" groove, and the strip can be folded along the "V" groove in either direction to accommodate any corner angle.

The strip is flat when first uncoiled, and scissors can be used to easily cut the length and any small section may be removed from the strip anywhere on its length.

According to important features of my invention I have provided a foldable translucent corner protector comprised of a flat strip of synthetic plastic, the cover protector having a V-shaped groove extending its length, the V-shaped groove dividing the strip and enabling the strip to be bent from a flat form along its length to provide a pair of bendable strip leaves for attachment to an angled wall surface of varying sized angles about a wall corner for protecting the wall corner, the leaves being joined together at the bottom of the V-shaped groove by a web, the web having a thickness of 1/64" or less According to another feature of my invention I have provided a foldable translucent corner protector comprised of a length of a flat parallel sided strip of coilable semi-rigid polycarbonate having high impact strength and being translucent. The parallel sided strip being of uniform cross section along its length. The parallel sided strip being coilable with outer parallel sided strip edges in coiled pressing engagement with one another. The corner protector having a V-shaped groove extending along the length of the strip. The V-shaped groove dividing the strip and enabling the strip to be bent from a flat form along the length to provide a pair of bendable strip leaves bendable into right angled relationship to one another for attachment to a right angled wall surface for exposed protection to a wall corner. The leaves being joined together at the bottom of the V-shaped groove by a web. The leaves on opposite ends of the V-shaped groove being flush engaged with an outside surface of the wall corner.

DETAILED DESCRIPTION

Figure 1:
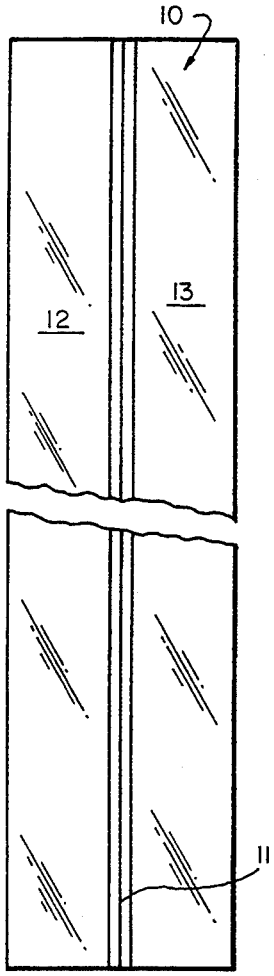
FIG. 1 is a fragmentary side elevation of my strip after the strip has been uncoiled and is ready to be trimmed.

As shown in the drawings, a preferred corner protection device or strip 10 is provided. In accordance with the present invention the clear synthetic plastic strip 10 is 1½" wide with a "V" groove 11 running along the length of the strip. The "V" groove 11 is begun from a center of the strip and is continued up from such point at an angle greater than 45° in both upward and outward directions providing a pair of leaves 12 and 13 in order to accommodate both acute and obtuse angled corners. The strip 10 has opposite flat sides 21 and 22 which are parallel to one another. One side 21 is spaced from an apex or web 17 of the "V" groove 11 is 1/64" or less from the flat side 21 of the strip. This allows the apex or web 17 of the groove 11 to act as a hinge when folded as shown by the dotted and full lines in FIGS. 4 and 4*a*. The "V" groove has a pair groove surfaces 20.

Figure 4:
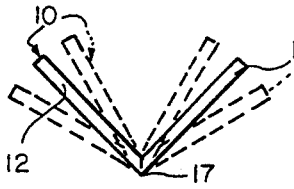
FIG. 4 is an end elevation showing the flexibility of my corner strip and showing some of the varying angles in which the corner protector can be folded.
Figure 4A:
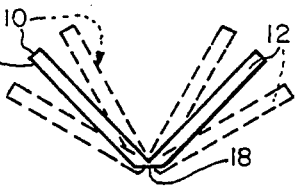
FIG. 4*a* is an elevation of the strip shown in FIG. 4 only with the strip being folded in an opposite direction to provide a flat type corner where my corner protector is installed on a wider angled corner.
Figure 5:
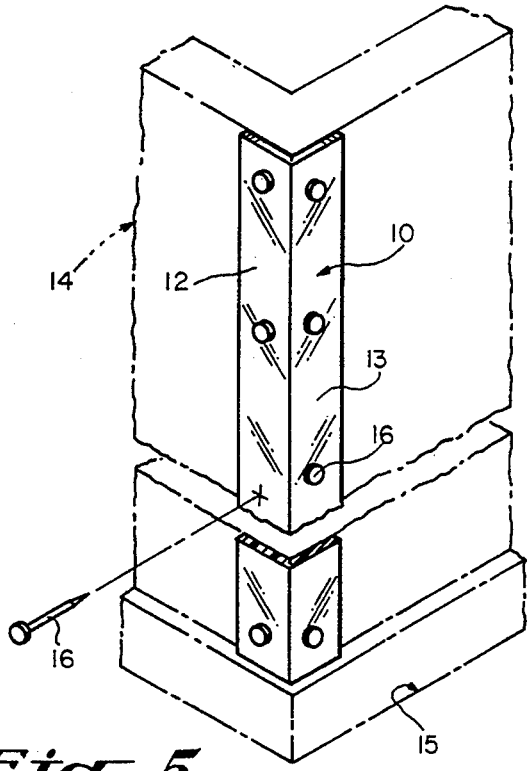
FIG. 5 is an enlarged fragmentary exploded outside perspective view of my corner protector installed on a corner which corner is shown by phantom lines.
Figure 2:
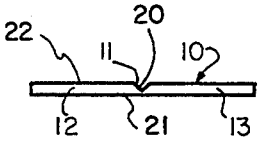
FIG. 2 is an end view of my plastic strip.
Figure 3:
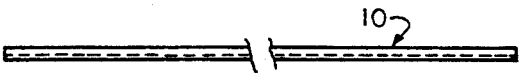
FIG. 3 is a fragmentary side elevation of my corner strip.

The strip 10 is adapted to be mounted on a wall corner such as is shown in FIG. 5 at 14. The wall corner may have a base board 15 at its lower bottom edge. The strip 10 can be installed on the corner 14 by bending it in either position as shown in FIG. 4 and FIG. 4*a* depending on the angularity of the outside surface of the corner. In the illustrated embodiment, the corner is shown as a right angle corner and hence the strip 10 should be folded with its leaves positioned as shown in the full line position in FIG. 4 with the groove 11 being on the inside of the corner. When the strip 10 is thus folded, it can be secured to the wall corner by suitable means such as nails shown at 16 or by a suitable adhesive. The nails are sharp tipped and can be driven easily through the plastic to complete the attachment of the corner strip to the wall.

As will be observed in FIGS. 4 and 4*a*, the strip 10 when folded in the position shown by the full lines in FIG. 4 has a peaked or angled corner shown in a 90° position. Where the strip 10 is turned upside down so that the groove faces downwardly then the leaves 12 and 13 can be lifted to form what is identified here as a so called flat corner 18. The strip is folded to be provided with a flat corner in situations where the wall corner 14 has an angle of greater than 90°. In instances of this type, the groove 11 is disposed at the bottom at 18 as shown in FIG. 4*a*.

The flat flexible strip may be coiled up into a circular coil and secured by a sticky type tape or other suitable tie holding it in a coiled position allowing it to be easily placed into a shopping bag and transported in any automobile or cart. The parallel sided strip is coilable with outer parallel sided strip edges in coiled pressing engagement with one another. This flat flexible strip is shown in a coiled position in FIG. 6 and an adhesive plastic tape tie 19 as shown for securing the strip in a circular coil for easy handling by a consumer.

Figure 6:
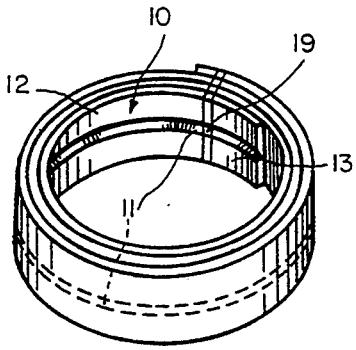
FIG. 6 shows the flexibility of my flat plastic strip while stored in a coiled position in readiness for use.
Figure 7:
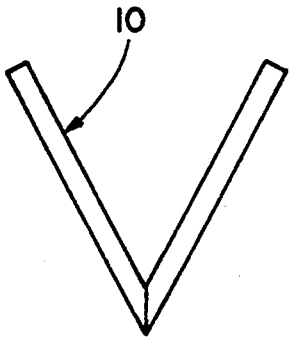
FIG. 7 is an end view of a corner protector as shown in FIG. 4 showing the corner protector being bent so that the opposing sides of the groove are engaged against one another.
Figure 8:
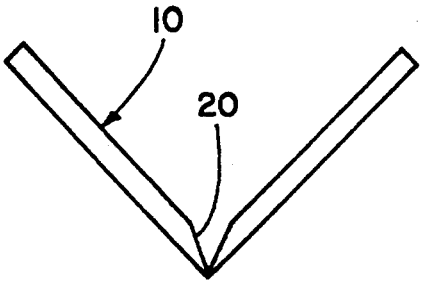
FIG. 8 is an end view of the corner protector as also shown in FIG. 4 which illustrates the corner protector in another position demonstrating how it would appear when installed on a right angled corner.
Figure 9:
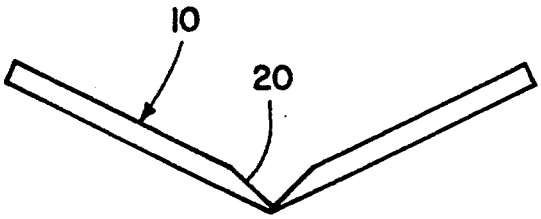
FIG. 9 is a end view of the corner protector diagrammatically shown in FIG. 4 only showing the corner protector in an open position as it would be installed on a 50 degree corner.

My corner strip can be preferably made from a semi-rigid polycarbonate since material of this type has high impact strength, and excellent translucency qualities. Further, semi-rigid polycarbonate material when used in strip form as shown at 10 in FIG. 1 can be easily trimmed and coiled as shown in FIG. 6. My strip is preferably extruded so that mold lines can be avoided whereby the strip will have unmarked surfaces. Since most floor to ceiling distances are approximately 8 feet it is contemplated that these strips should be marketed in 8 foot lengths. Where the strip 10 is coiled, it can be preferably coiled into a 10 inch diameter circle to reduce any spring when a strip is uncoiled all as shown in FIG. 6.

The preferred embodiment of my strip has a thickness of 1/16 inch with a webbed thickness of 1/64 inch. Wider strips may be used to cover more area further from a wall corner but I have found the preferred width to be 1½ inches. The V-shaped groove 11 is intended to have an angle of greater than 45°. As has been noted previously, the strip can be used with the groove 11 either side out when installed on a corner 14. As mentioned before, the strip can be attached by the nails 16 or can be secured by an acrylic adhesive, if desired.

The basic and novel characteristics of the improved apparatus of the present invention will be readily understood from the foregoing disclosure by those skilled in the art. It will become readily apparent that various changes and modifications may be made in the form, construction and arrangement of the improved apparatus of the present invention as set forth hereinabove without departing from the spirit and scope of the invention. Accordingly, the preferred and alternative embodiments of the present invention set forth hereinabove are not intended to limit each spirit and scope in any way.

I claim:

1. In combination, a wall structure and a foldable translucent corner protector comprised of a length of a flat parallel sided strip of coilable semi-rigid polycarbonate having high impact strength and being translucent, the parallel sided strip being of uniform cross section along its length, the parallel sided strip being coilable with outer parallel sided strip edges in coiled pressing engagement with one another, the corner protector having a V-shaped groove extending along the length of the strip, the V-shaped groove dividing the strip and enabling the strip to be bent from a flat form along the length to provide a pair of bendable strip leaves bendable into right angled relationship to one another for attachment to a right angled wall surface for exposed protection to a wall corner, the leaves being joined together at the bottom of the V-shaped groove by a web, the leaves on opposite ends of the V-shaped groove being flush engaged with an outside surface of the wall corner.

2. The combination of claim 1 further characterized by the strip being foldable about said V-shaped groove in either direction for attachment over the wall corner providing in one instance a sharp angled strip corner and in another instance where reverse folded then providing a flat type corner.

3. The combination of claim 1 wherein the web has a thickness of not more than 1/64".

* * * * *